US010828537B2

(12) United States Patent
Smith

(10) Patent No.: US 10,828,537 B2
(45) Date of Patent: Nov. 10, 2020

(54) PORTABLE DEVICE FOR CLEANING GOLF BALLS AND GOLF CLUBS

(71) Applicant: Danny Warren Smith, Chicago, IL (US)

(72) Inventor: Danny Warren Smith, Chicago, IL (US)

( * ) Notice: Subject to any disclaimer, the term of this patent is extended or adjusted under 35 U.S.C. 154(b) by 76 days.

(21) Appl. No.: 16/374,686

(22) Filed: Apr. 3, 2019

(65) Prior Publication Data

US 2019/0308078 A1 Oct. 10, 2019

Related U.S. Application Data

(60) Provisional application No. 62/654,154, filed on Apr. 6, 2018.

(51) Int. Cl.

| | |
|---|---|
| ***A63B 47/04*** | (2006.01) |
| ***A63B 57/60*** | (2015.01) |
| ***A63B 55/00*** | (2015.01) |

(52) U.S. Cl.

CPC ..... *A63B 47/04* (2013.01); *A63B 55/408* (2015.10); *A63B 57/60* (2015.10)

(58) Field of Classification Search

CPC ..... A63B 47/04; A63B 55/408; A63B 57/60
See application file for complete search history.

(56) References Cited

U.S. PATENT DOCUMENTS

| | | | | |
|---|---|---|---|---|
| 4,210,974 | A * | 7/1980 | Stoltzman | A63B 47/04 15/21.2 |
| 4,701,968 | A * | 10/1987 | Stoltzman | A63B 47/04 15/21.2 |
| 4,945,596 | A | 8/1990 | Chang et al. | |
| 4,965,906 | A | 10/1990 | Mauro | |
| 5,155,883 | A | 10/1992 | Legault | |
| 5,269,615 | A * | 12/1993 | Lewis, Jr. | A46B 9/02 401/10 |
| 5,572,761 | A * | 11/1996 | Meyer | A63B 47/04 15/104.92 |
| 6,269,509 | B1 * | 8/2001 | Mays | A46B 13/02 134/191 |
| 6,695,509 | B1 | 2/2004 | Dowe, Sr. | |
| 6,745,424 | B1 | 6/2004 | Pimentel et al. | |
| 10,286,262 | B1 * | 5/2019 | Yost | B05B 11/3059 |

* cited by examiner

*Primary Examiner* — Randall E Chin
(74) *Attorney, Agent, or Firm* — Foley & Lardner LLP

(57) ABSTRACT

A portable device for cleaning golf balls and golf clubs is provided. The device may include a hollow, impermeable housing and an impermeable lid. Situated on the lid beneath the lid inner surface is a plunger with a saddle in which to rest a golf ball. The device also contains a plurality of cleaning mechanisms disposed within an inner cavity of the housing and arranged to form a channel, so that when a user submerges and reciprocates the plunger, the golf balls are cleaned. The device may further include a spray nozzle to dispense cleaning solution onto golf clubs. A tee holder, divot fixer holder, and towel holder may also be coupled to the exterior of the housing. The device is preferably sized and shaped to be disposed within or coupled to a golf bag or golf cart.

20 Claims, 9 Drawing Sheets

PORTABLE DEVICE FOR CLEANING GOLF BALLS AND GOLF CLUBS

CROSS-REFERENCE TO RELATED APPLICATIONS

This application claims the benefit of U.S. Provisional Patent Application No. 62/654,154, filed on Apr. 6, 2018, the entire contents of which are incorporated herein by reference.

FIELD OF USE

This application generally relates to portable devices for cleaning golf balls and golf clubs that can easily travel with a golfer throughout a round of golf.

BACKGROUND

During the game of golf, it is common for golf balls and golf clubs to be exposed to natural materials such as dirt, grass, and sand. Such materials on the face of a golf club and/or on a golf ball may impact the trajectory of a player's ball, thus altering where the ball travels on the course, and the player's score. To reduce such issues, many golf courses are equipped with stationary golf ball cleaners, but those cleaners are often only available at the tee box and not necessarily at the tee box of every hole.

Various known technologies have sought to address the issue of cleaning dirty golf clubs and golf balls. U.S. Pat. No. 6,745,424 to Pimentel describes a portable golf cleaner sized to fit both golf balls and golf clubs. Yet, due to the volume of the cleaner when filled with cleaning solution, a substantial amount of weight is added to the golfer's load, making the cleaner too cumbersome to be easily portable. Also, because the cleaner uses the same housing area to clean the golf ball and golf clubs, the cleaning chamber is poorly fitted to both the ball and the club head, sized improperly for both. The combination golf club and golf ball cleaner described in U.S. Pat. No. 5,155,883 to Legault suffers from similar drawbacks. U.S. Pat. No. 6,695,509 to Dowe describes a twisting device, in which a golf ball is placed between two connectable ends and spun to clean. Yet the design does not provide a watertight or liquid-tight housing, leaving golf bags and golf carts at risk of exposure to leaked cleaning fluids. The twisting device also may not achieve full reciprocation and, thereby, only cleans half the ball. U.S. Pat. No. 4,945,596 to Chang describes a multifaceted portable golf cleaner that clips onto the side of golf bags or carts. However, that cleaner has a long, thin handle that is prone to mechanical wear and failure. U.S. Pat. No. 4,965,906 to Mauro describes a combination golf ball and golf club cleaner that is mounted to the end of a golf cart and is not adapted to fit golf bags, making the cleaner less portable.

It would therefore be desirable to provide a lightweight, portable, durable, easy-to-use golf ball and golf club cleaning device to avoid playing with a dirty golf ball and/or golf club that does not suffer from the drawbacks of available technology.

SUMMARY

The present technology overcomes the drawbacks of previously known systems by providing a portable device for cleaning golf balls or golf clubs. The portable golf device includes a hollow impermeable housing sized and shaped to be disposed within, or coupled to, a golf bag. The hollow, impermeable housing may have an inner cavity, an outer surface, an upper end, and a lower end, the upper end defining an opening and the inner cavity configured to hold a cleaning fluid at the lower end. The portable golf device may have a plurality of cleaning mechanisms disposed within the inner cavity of the housing and arranged, e.g., circumferentially, to form a channel. The device also may have an impermeable lid sized and shaped to create a fluid-tight seal at the opening when in a closed position. The impermeable lid has a lid outer surface and a lid inner surface. The device preferably includes a plunger disposed within the inner cavity beneath the lid inner surface in the closed position. The plunger may have a ball saddle configured to hold a golf ball, such that movement of the plunger caused by user actuation at a handle moves the golf ball held at the ball saddle within the channel to contact the cleaning fluid and the plurality of cleaning mechanisms to clean the golf ball. The device further may include a spray nozzle disposed outside the outer surface of the hollow, impermeable housing and a conduit coupled to the spray nozzle and extending into the inner cavity of the hollow, impermeable housing to permit fluidic communication with the cleaning fluid inside the hollow, impermeable housing. Actuation of the spray nozzle causes the cleaning fluid to travel through a lumen in the conduit to be dispensed out the spray nozzle at a force sufficient to clean a golf club face.

A handle may be coupled to the impermeable lid above the lid's outer surface. The impermeable lid may have a lid opening from the lid outer surface to the lid inner surface where the plunger is designed to move longitudinally through the opening in a reciprocating manner responsive to the user actuation at the handle to clean the golf ball, while the impermeable lid remains in place to maintain the fluid-tight seal.

Inside the cavity, a filter may be operatively coupled to the conduit to reduce an amount of solid particles in the cleaning fluid that reach the spray nozzle. A one-way valve may be operatively coupled to the conduit to permit the cleaning fluid to only travel from the inner cavity towards the spray nozzle. In order to facilitate a fluid-tight seal when the lid is in a closed position, the device may have a gasket disposed between the impermeable lid and the opening to facilitate. The gasket may have hooks that connect to clasps on the hollow impermeable housing when in the closed position. Alternatively, in another embodiment, the impermeable lid may have threads configured to mate with opposing threads at the opening of the hollow, impermeable housing.

A stopper may be coupled to the plunger to prevent the plunger from traveling beyond the bottom surface of the lid or another predetermined distance inside the cavity. On the exterior of the housing, a hand pump may be configured to pressurize the cleaning fluid disposed in the conduit for dispensing the cleaning fluid. A towel holder also may be coupled to the outer surface of the hollow, impermeable housing.

The device also may include an elongated clip coupled to the outer surface of the hollow, impermeable housing adjacent to the upper end. The elongated clip may be preferably biased toward the outer surface to anchor the portable golf device to a golf bag or golf cart. In one embodiment, a first end of the elongated clip may be coupled to the outer surface and a second end of the elongated clip extends past the lower end of the hollow, impermeable housing. The plurality of cleaning mechanisms may be, for example, brushes, bristles, pads, and/or scrubbers.

The handle of the device also may be made to resemble the face of a cartoon character, such as a butler. In order to further resemble a cartoon butler, the outer surface of the hollow, impermeable housing may include a bowtie and belt. A tee holder may be coupled to the outer surface of the hollow, impermeable housing, which may resemble a belt of the butler. The tee holder further may hold a divot fixer at a position such that the divot fixer resembles a belt buckle. The bowtie also may be a ball marker holder coupled to the outer surface of the hollow, impermeable housing. The ball marker holder holds one or more ball markers.

DETAILED DESCRIPTION

A portable device for cleaning golf balls and golf clubs is provided herein. The portable device illustratively includes a hollow impermeable housing and an impermeable lid, with the impermeable lid sized and shaped to create a fluid-tight seal at the opening of the housing when in a closed position. A plunger may be situated at the lid beneath the lid inner surface. The plunger has a ball saddle in which to rest a golf ball. The device also contains a plurality of cleaning mechanisms disposed within an inner cavity of the housing and arranged, e.g., circumferentially, to form a channel in which a user can activate the plunger. As the plunger is reciprocated by the user, the plunger brings the golf ball in contact with the cleaning mechanisms in a reciprocating motion to clean the golf ball. The device may also include a spray nozzle disposed on the outer surface of the hollow, impermeable housing, which draws cleaning solution from the housing, through a conduit, and dispenses the cleaning solution onto golf clubs. The device is sized and shaped to be disposed within or coupled to a golf bag.

Referring to FIGS. 1A-1E, an exemplary device used to clean golf balls and golf clubs in accordance with the principles of the present disclosure is described.

Figure 1A:
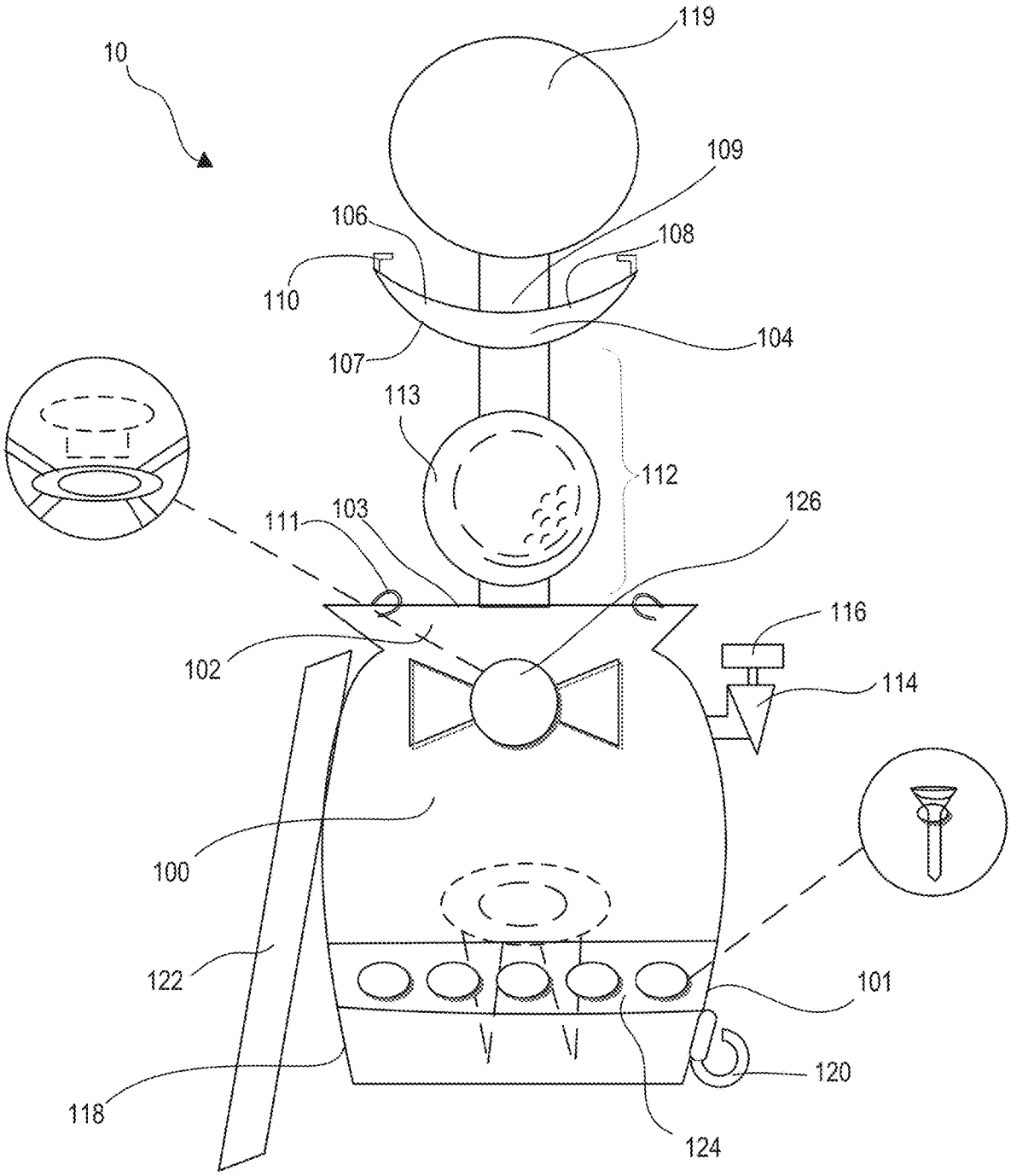
FIG. 1A illustrates a front outside view of the device in the ball receiving position.

FIG. 1A illustrates a front outside view of device 10 in a ball receiving position. Device 10 includes impermeable housing 100 having lower end 101 and upper end 102 defining upper end opening 103 that is closable by impermeable lid 104. Impermeable lid 104 is sized and shaped to create a fluid-tight seal at upper end opening 103 when in a closed position. Impermeable lid 104 has lid outer surface 106 and lid inner surface 107. Impermeable lid 104 further may include a gasket 108 disposed between impermeable lid 104 and lid opening 109 to facilitate a fluid-tight seal in the closed position. Impermeable lid 104 may have lid couplers 110, e.g., illustratively hooks, configured to be coupled to housing couplers 111, e.g., illustratively clasps, helping to secure impermeable lid 104 when in the closed position. Gasket 108 may be rubber, e.g., a rubber O-ring, and forms a fluid-tight sealing junction when connected in closed position with upper end opening 103 of housing 100. Plunger 112 is a component that sits at least partially below lid inner surface 107 for reciprocating the golf ball within impermeable housing 100 for cleaning. Plunger 112 is fitted to enter impermeable housing 100 and is designed to be reciprocated therein. Ball saddle 113 is situated on plunger 112 and is sized and shaped to hold a golf ball. FIG. 1A also shows spray nozzle 114 and hand pump 116 disposed outside outer surface 118 of hollow, impermeable housing 100. When hand pump 116 is actuated and depressed by a user, spray nozzle 114 dispenses cleaning solution from inside impermeable housing 100. Spray nozzle 114 encompasses any device or piece used to spray liquid from inside impermeable housing 100 to outside impermeable housing 100. Handle 119 is coupled to impermeable lid 104 at lid outer surface 106. Handle 119 allows a user to grip while reciprocating impermeable lid 104 as many times as necessary to clean a golf ball.

Device 10 further may include towel holder 120 coupled to outer surface 118 of hollow, impermeable housing 100. Towel holder 120 is available for a golfer to carry a towel to dry or wipe their golf clubs after using spray nozzle 114 to clean the club. Elongated clip 122 is coupled to outer surface 118 of hollow, impermeable housing 100 adjacent to upper end 102. Elongated clip 122 is biased toward outer surface 118 to anchor portable golf device 10 to a golf bag or golf cart via elongated clip 122. A first end of elongated clip 122 may be coupled to outer surface 118 and a second end of elongated clip 122 extends past lower end 101 of hollow, impermeable housing 100. Device 10 also may have tee holder 124. Tee holder 124 is shown coupled to outer surface 118 of hollow, impermeable housing 100. Tee holder 124 may resemble a belt. Tee holder 124 further may be configured to hold a divot fixer, and tee holder 124 further may be configured to hold the divot fixer at a position such that the divot fixer resembles a belt buckle. Device 10 may also include ball marker holder 126. Ball marker holder 126 may be coupled to outer surface 118 of hollow, impermeable housing 100, and configured to hold one or more ball markers. In one embodiment, outer surface 118 of hollow, impermeable housing 100 has ball marker holder 126 resembling a bowtie, tee holder 124 resembling a belt with a divot fixer resembling a belt buckle, and handle 119 resembling a face of a cartoon butler.

Figure 1B:
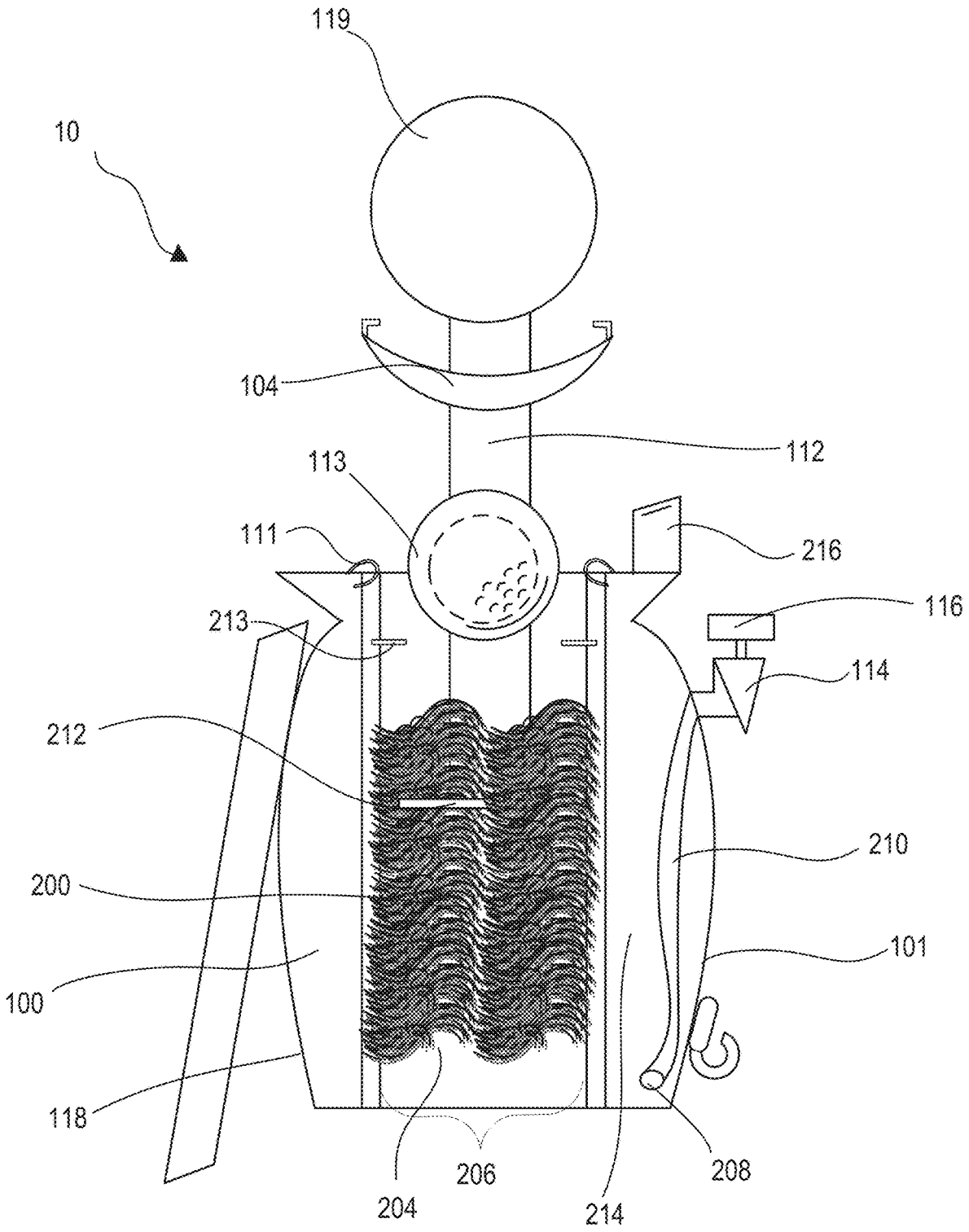
FIG. 1B shows a cross-sectional view of the device in the ball receiving position.

FIG. 1B shows a cross-sectional view of device 10 in ball receiving position. Hollow, impermeable housing 100 further defines inner cavity 200. Inner cavity 200 is configured to hold a cleaning fluid at lower end 101. A plurality of cleaning mechanisms 204 are disposed within inner cavity 200 of housing 100 and circumferentially arranged to form channel 206. Cleaning mechanisms 204 may be, for example, brushes, bristles, pads, or scrubbers. Outer surface 118 of impermeable housing 100 is shown exterior to inner cavity 200. Channel 206 is part of inner cavity 200 and is sized to fit plunger 112 and ball saddle 113 when handle 119 is actuated and reciprocated by the user. Plunger 112 is disposed within inner cavity 200 beneath lid inner surface 107 in the closed position. Plunger 112 has ball saddle 113 configured to hold a golf ball. Movement of plunger 112 caused by user actuation of handle 119 moves the golf ball held at ball saddle 113 within channel 206 to contact the cleaning fluid and plurality of cleaning mechanisms 204 to clean the golf ball. As used herein, ball saddle 113 encompasses a space in which to rest and secure a golf ball. In order to clean golf clubs, conduit 210 is coupled to spray nozzle 114 and extending into inner cavity 200 of hollow, impermeable housing 100 to permit fluidic communication with the cleaning fluid at lower end 101 of hollow, impermeable housing 100. Actuation of spray nozzle 114 causes the cleaning fluid to travel through lumen 208 in conduit 210 to be dispensed out spray nozzle 114 at a force sufficient to clean a golf club face. This embodiment further may include hand pump 116 configured to pressurize the cleaning fluid disposed in conduit 210 for dispensing the cleaning fluid. In one embodiment, stopper 212 may be coupled to plunger 112 to prevent plunger 112 from traveling beyond one or more catches 213 or another predetermined distance inside cavity 200. In this embodiment, impermeable housing 100 may include side compartment 214 which contains conduit 210 and cleaning solution separate from inner cavity 200. Side compartment lid 216 opens and closes side compartment 214 to prevent leakage of cleaning solution.

Figure 1C:
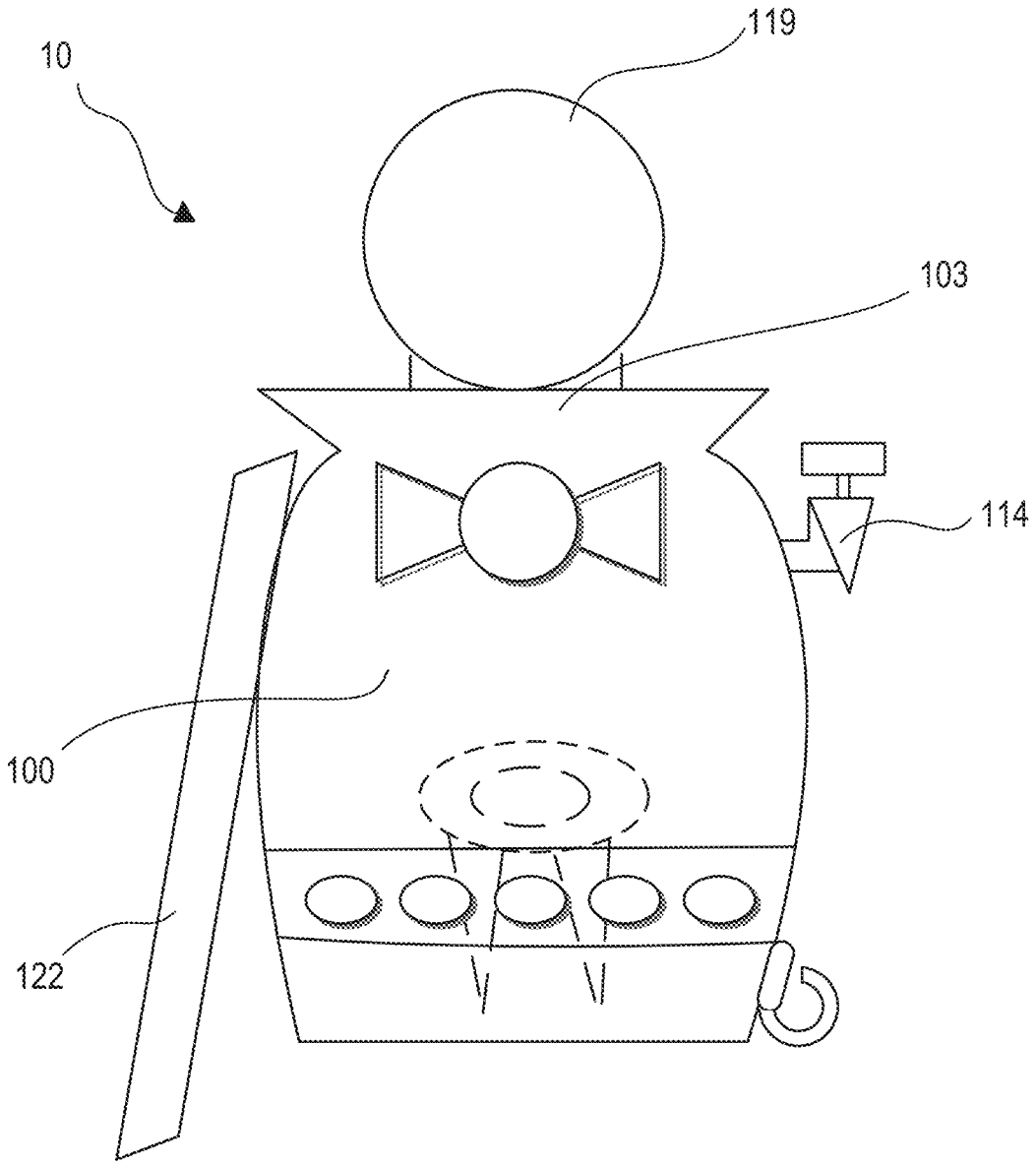
FIG. 1C shows a front outside view of the device in the ball cleaning position.

FIG. 1C illustrates a front outside view of device 10 in ball cleaning position. From this perspective, the golf ball is inside impermeable housing 100 and handle 119 is shown in proximity to upper end opening 103 of impermeable housing 100. Spray nozzle 114 is capable of dispensing cleaning solution whether device 10 is in ball receiving position or ball cleaning position. Elongated clip 122 is designed to couple device 10 to a golf bag or a golf cart.

Figure 1D:
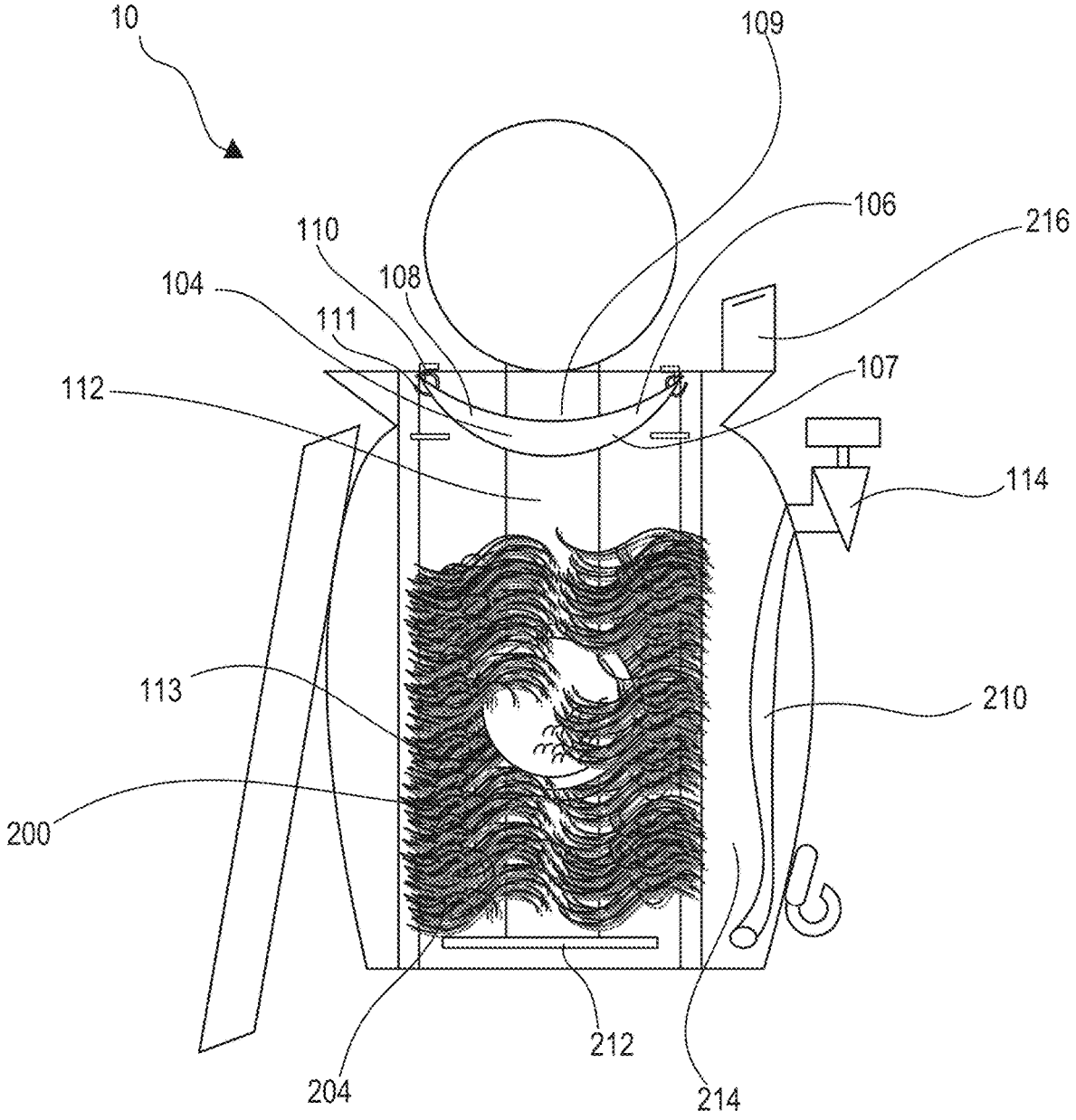
FIG. 1D illustrates a cross-sectional view in the ball cleaning position.

FIG. 1D illustrates a cross-sectional view of device 10 in ball cleaning position. Plunger 112 is shown lowered into inner cavity 200, with the ball in ball saddle 113 and contacting cleaning mechanisms 204. Impermeable lid 104 further defines lid opening 109 from lid outer surface 106 to lid inner surface 107, where plunger 112 is configured to move longitudinally through lid opening 109 in a reciprocating manner responsive to the user actuation at handle 119 to clean the golf ball, while impermeable lid 104 remains in place to maintain the fluid-tight seal. When in ball cleaning position, device 10 is liquid impermeable, since gasket 108 is fitted inside upper end opening 103 in a manner that creates a fluid-tight seal when in a closed position. Impermeable lid 104 also may be equipped with one or more lid couplers 110 shown connected to housing couplers 111 on hollow impermeable housing 100, helping to secure impermeable lid 104 when in the closed position. In both ball receiving and ball cleaning position, side compartment 214 is capable of holding cleaning solution and can be closed using side compartment lid 216. Moreover, spray nozzle 114 can also distribute cleaning solution from side compartment 214 through conduit 210. In order to facilitate a fluid-tight seal, lid 104 is sized so that fluid cannot pass through when lid 104 is closed in ball cleaning position.

Figure 1E:
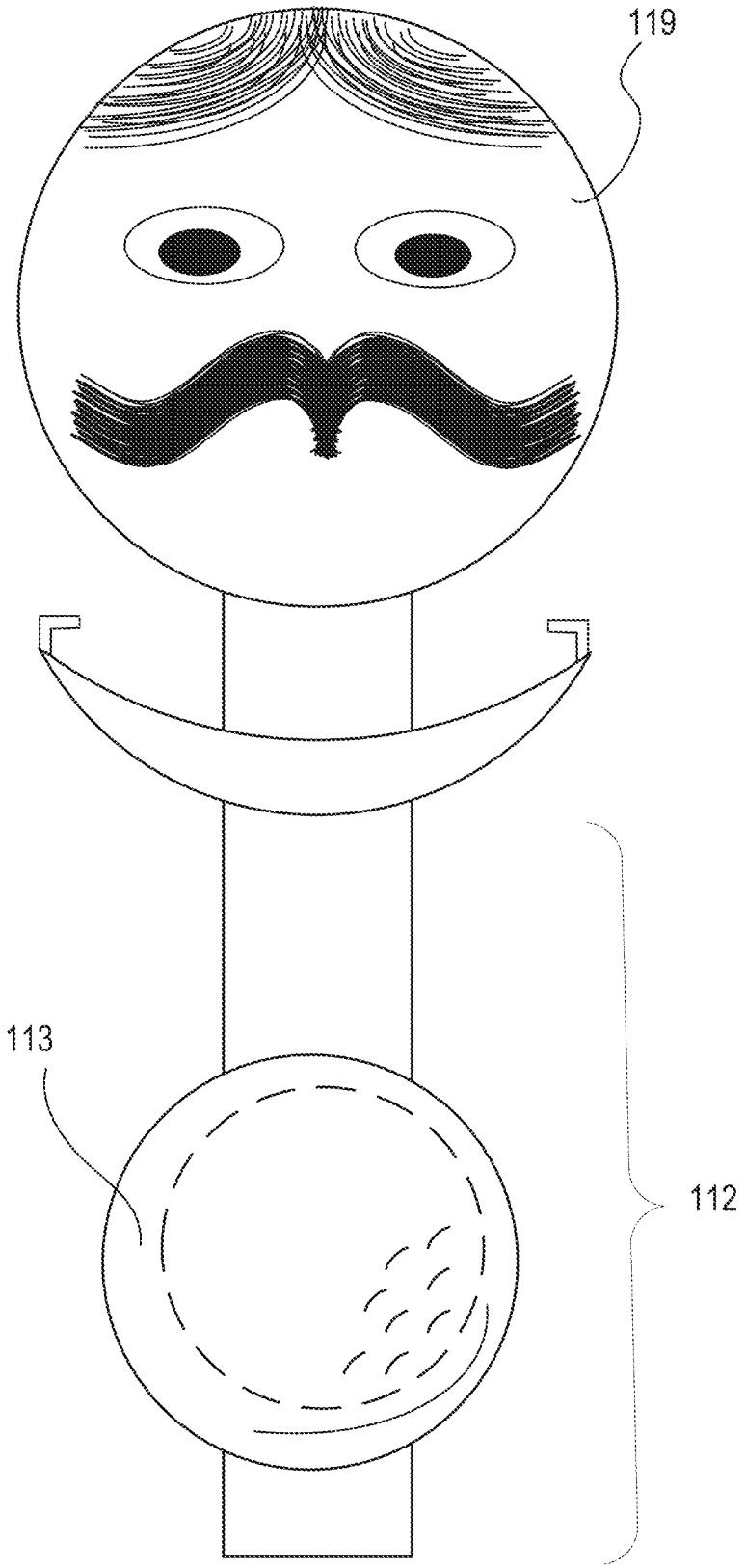
FIG. 1E depicts the handle of the device resembling the face of a cartoon butler.

FIG. 1E shows a depiction of handle 119 resembling the face of a cartoon butler.

Figure 2:
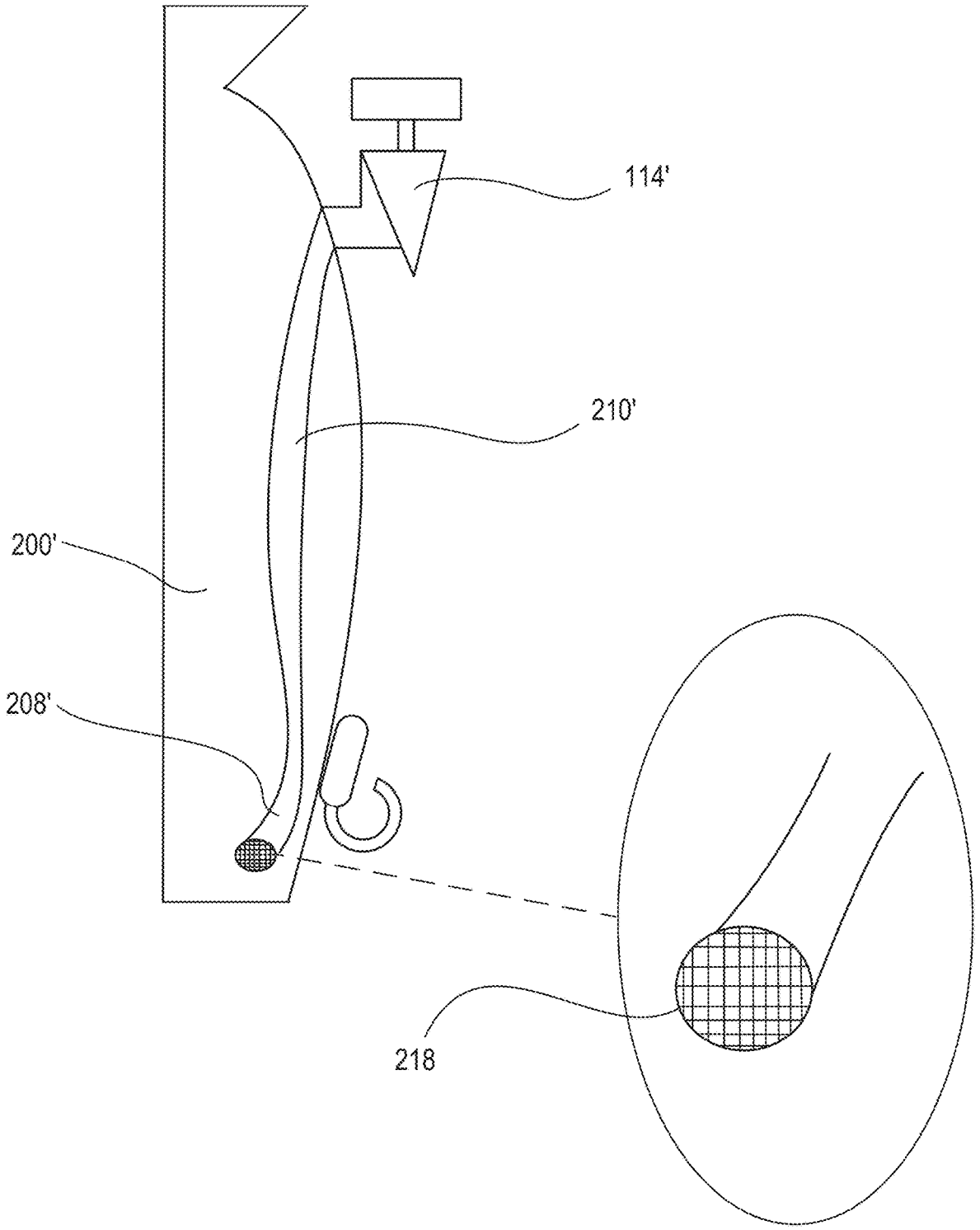
FIG. 2 shows an embodiment of the device with a filtered conduit to keep solid particles from entering the conduit.

FIG. 2 shows an embodiment of the device wherein conduit 210' has filter 218 operatively coupled to conduit 210' to reduce an amount of solid particles in the cleaning fluid from reaching spray nozzle 114'. Filter 218 keeps the cleaning solution that travels from spray nozzle 114' to the golf club from having unwanted particulate matter. In this embodiment, a separate side compartment 214' is not needed, rather conduit 210' is directly connected to inner cavity 200'. Filter 218 can be made of a mesh material or any material sized to block particulate matter from entering lumen 208'.

Figure 3:
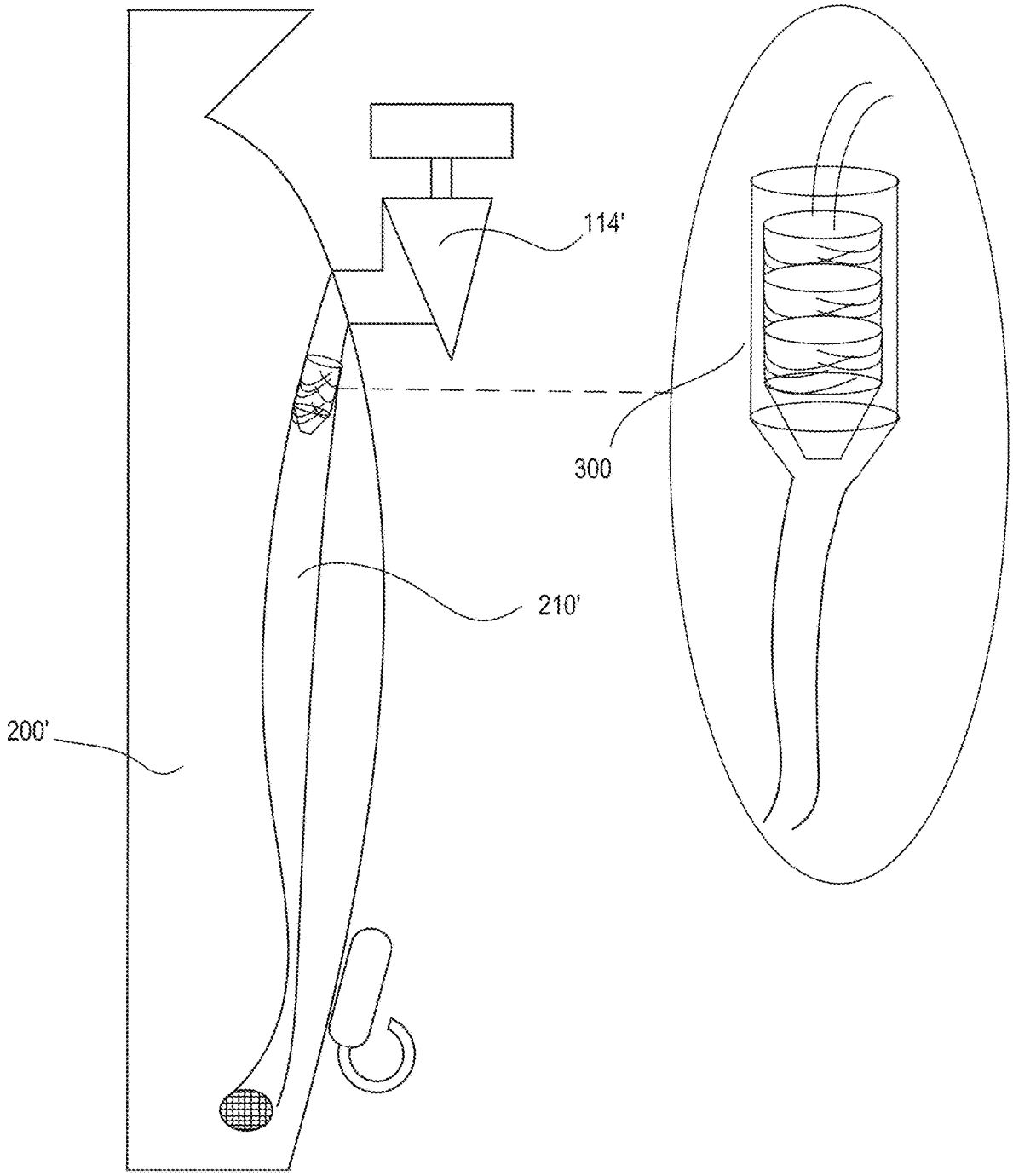
FIG. 3 shows an embodiment where the conduit has a one way valve to reduce solid particles from entering the conduit.

FIG. 3 shows an embodiment in which one-way valve 300 is operatively coupled to conduit 210' to permit the cleaning fluid to only travel from inner cavity 200' towards spray nozzle 114' and to reduce solid particles from entering conduit 210'.

Figure 4:
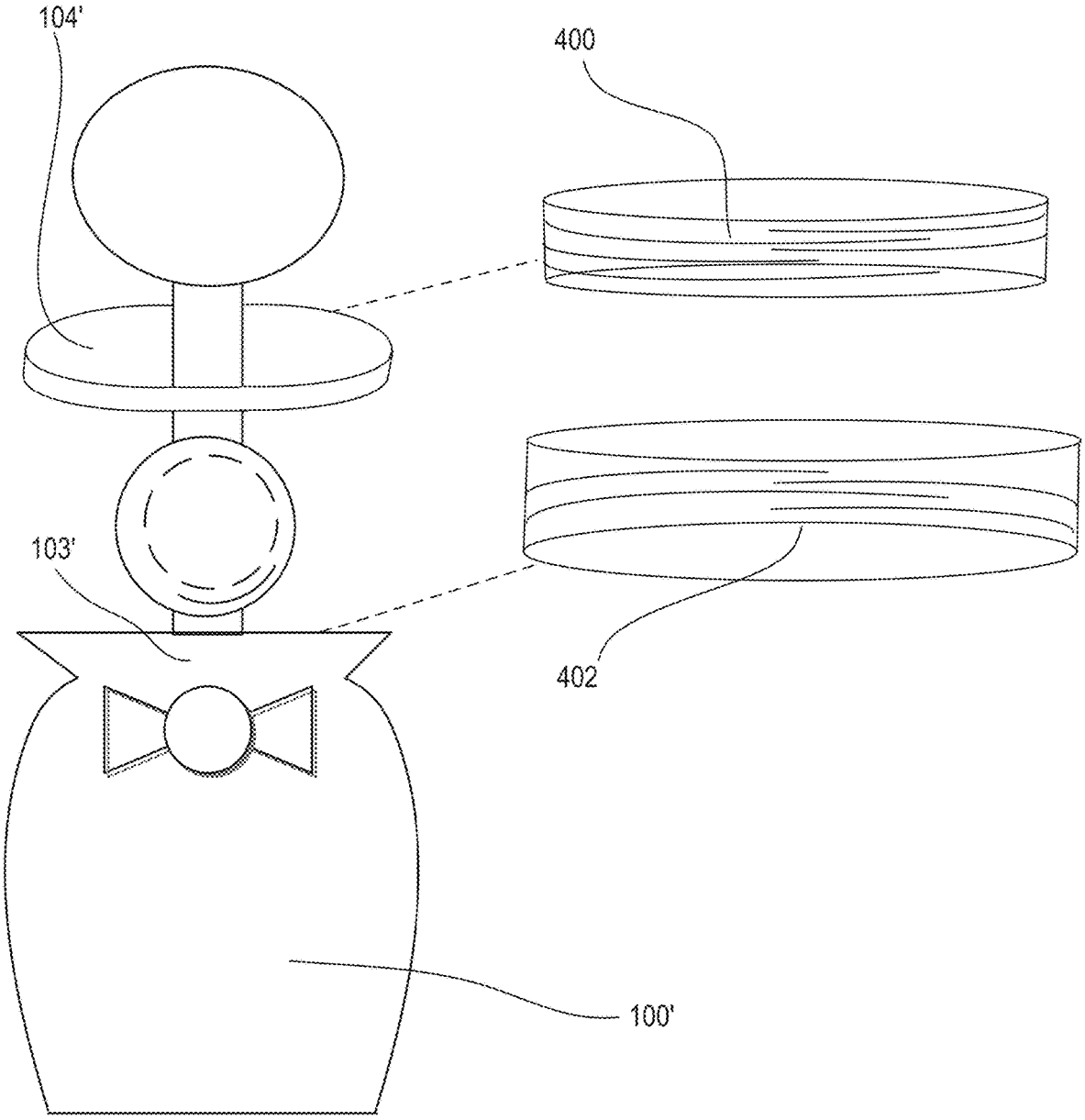
FIG. 4 illustrates an embodiment where the impermeable lid has threads to mate with opposing threads at the opening of the hollow, impermeable housing.

FIG. 4 depicts another embodiment wherein impermeable lid 104' has threads 400 configured to mate with opposing threads 402 on housing 100' at upper end opening 103'. In this embodiment, lid threads 400 and housing threads 402 are mated when hollow impermeable housing 100' and impermeable lid 104' are twisted together in closed position.

Figure 5:
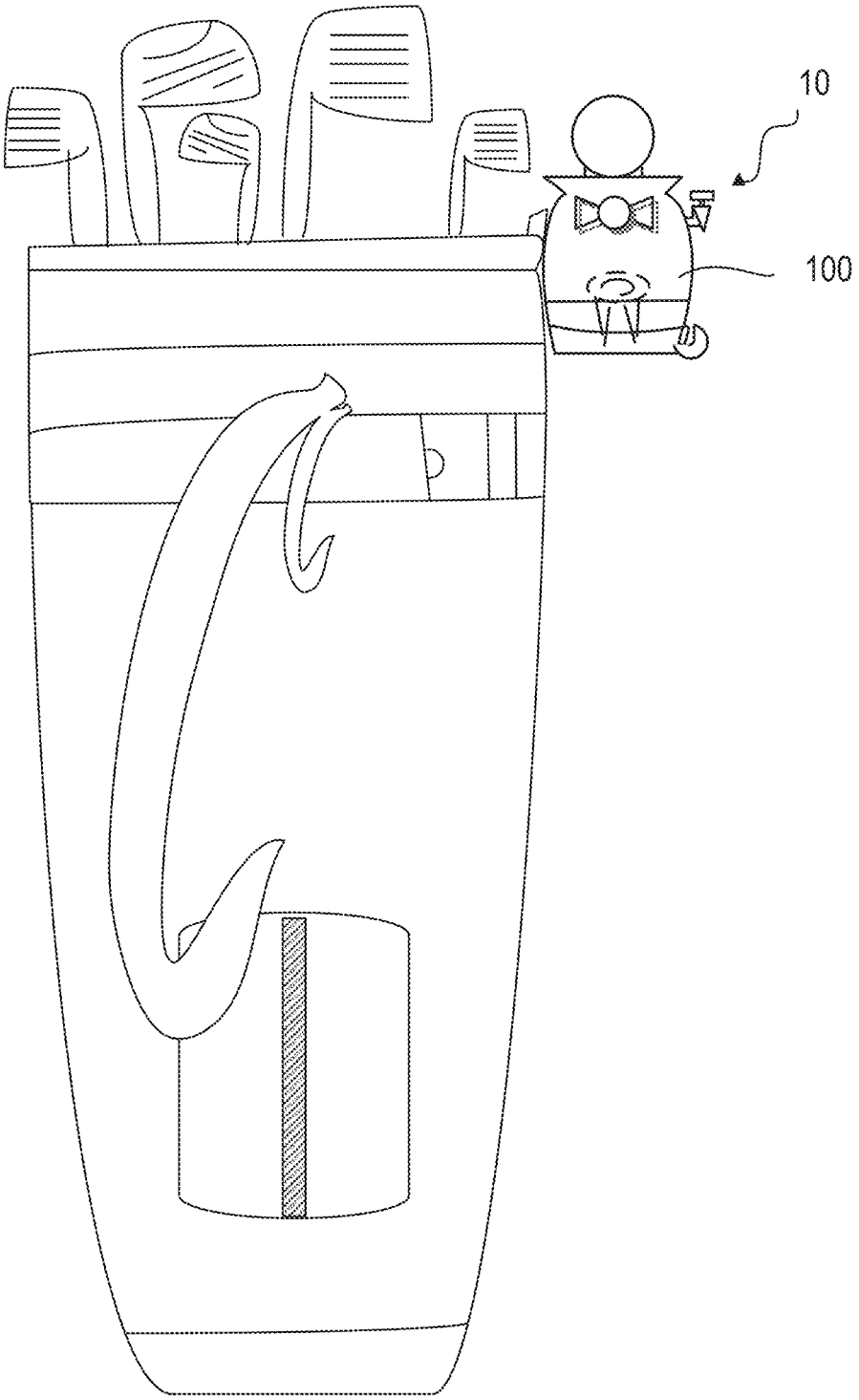
FIG. 5 shows the device attached to the exterior of a golf bag.

FIG. 5 shows a view of device 10 attached on the exterior of a golf bag. Hollow impermeable housing 100 may be sized and shaped to be disposed within, or coupled to, a golf bag or golf cart. For example, device 10 is preferably sized to fit within a pocket of a golf bag for easy portability.

While various illustrative embodiments of the invention are described above, it will be apparent to one skilled in the art that various changes and modifications may be made therein without departing from the invention. The appended claims are intended to cover all such changes and modifications that fall within the true scope of the invention.

What is claimed:

1. A portable golf device for cleaning golf balls or golf clubs, the portable golf device comprising:

a hollow impermeable housing sized and shaped to be disposed within, or coupled to, a golf bag, the hollow, impermeable housing comprising an inner cavity, an outer surface, an upper end, and a lower end, the upper end defining an opening and the inner cavity configured to hold a cleaning fluid at the lower end;

a plurality of cleaning mechanisms disposed within the inner cavity of the housing and circumferentially arranged to form a channel;

an impermeable lid sized and shaped to create a fluid-tight seal at the opening when in a closed position, the impermeable lid comprising a lid outer surface and a lid inner surface;

a plunger disposed within the inner cavity beneath the lid inner surface in the closed position, the plunger comprising a ball saddle configured to hold a golf ball, wherein movement of the plunger caused by user actuation at a handle moves the golf ball held at the ball saddle within the channel to contact the cleaning fluid and the plurality of cleaning mechanisms to clean the golf ball;

a spray nozzle disposed outside the outer surface of the hollow, impermeable housing; and a conduit coupled to the spray nozzle and extending into the inner cavity of the hollow, impermeable housing to permit fluidic communication with the cleaning fluid at the lower end of the hollow, impermeable housing, wherein actuation of the spray nozzle causes the cleaning fluid to travel through a lumen in the conduit to be dispensed out the spray nozzle at a force sufficient to clean a golf club face.

2. The portable golf device of claim 1, wherein the handle is coupled to the impermeable lid at the lid outer surface.

3. The portable golf device of claim 1, wherein the impermeable lid defines a lid opening from the lid outer surface to the lid inner surface; and wherein the plunger is configured to move longitudinally through the opening in a reciprocating manner responsive to the user actuation at the handle to clean the golf ball while the impermeable lid remains in place to maintain the fluid-tight seal.

4. The portable golf device of claim 1, further comprising a filter operatively coupled to the conduit to reduce an amount of solid particles in the cleaning fluid that reach the spray nozzle.

5. The portable golf device of claim 1, further comprising a one-way valve operatively coupled to the conduit to permit the cleaning fluid to only travel from the inner cavity towards the spray nozzle.

6. The portable golf device of claim 1, further comprising a gasket disposed between the impermeable lid and the opening to facilitate the fluid-tight seal in the closed position, wherein the gasket comprises one or more hooks that operatively secure to one or more clasps on the hollow impermeable housing when in the closed position.

7. The portable golf device of claim 1, wherein the impermeable lid comprises threads configured to mate with opposing threads at the opening of the hollow, impermeable housing.

8. The portable golf device of claim 1, further comprising a stopper coupled to the plunger to prevent the plunger from traveling beyond a predetermined distance.

9. The portable golf device of claim 1, further comprising a hand pump configured to pressurize the cleaning fluid disposed in the conduit for dispensing the cleaning fluid.

10. The portable golf device of claim 1, further comprising a towel holder coupled to the outer surface of the hollow, impermeable housing.

11. The portable golf device of claim 1, further comprising an elongated clip coupled to the outer surface of the hollow, impermeable housing adjacent to the upper end, the elongated clip biased toward the outer surface to anchor the portable golf device to a golf bag or golf cart via the elongated clip.

12. The portable golf device of claim 11, wherein a first end of the elongated clip is coupled to the outer surface and a second end of the elongated clip extends past the lower end of the hollow, impermeable housing.

13. The portable golf device of claim 1, wherein the plurality of cleaning mechanisms are selected from a group consisting of a brush, bristle, pad, or scrubber.

14. The portable golf device of claim 1, wherein the impermeable housing comprises a side compartment and a side compartment lid that contains the conduit and cleaning solution separate from the inner cavity.

15. The portable golf device of claim 1, further comprising a tee holder coupled to the outer surface of the hollow, impermeable housing.

16. The portable golf device of claim 15, wherein the tee holder resembles a belt.

17. The portable golf device of claim 15, wherein the tee holder is further configured to hold a divot fixer.

18. The portable golf device of claim 17, wherein the tee holder is configured to hold the divot fixer at a position such that the divot fixer resembles a belt buckle.

19. The portable golf device of claim 1, wherein a ball marker holder is coupled to the outer surface of the hollow, impermeable housing, the ball marker holder configured to hold one or more ball markers.

20. The portable golf device of claim 1, wherein the outer surface of the hollow, impermeable housing comprises a ball marker holder resembling a bowtie, a tee holder resembling a belt, and a handle resembling a face of a cartoon butler.

* * * * *